United States Patent [19]

Cox

[11] Patent Number: 4,688,964

[45] Date of Patent: Aug. 25, 1987

[54] METHOD AND APPARATUS FOR APPLYING SEAL COATING TO ASPHALT PAVEMENT

[76] Inventor: Harold C. Cox, Rte. 1, Box 232, Claudville, Va. 24076

[21] Appl. No.: 878,850

[22] Filed: Jun. 26, 1986

[51] Int. Cl.[4] ..... E01C 21/00

[52] U.S. Cl. ..... 404/75; 404/111; 15/98

[58] Field of Search ..... 404/103, 111, 122, 123, 404/72, 75, 76, 83; 118/108, 305; 427/136; 239/172; 15/50 C, 98

[56] References Cited

U.S. PATENT DOCUMENTS

| | | | |
|---|---|---|---|
| 2,123,156 | 7/1938 | Jagoe | 239/172 X |
| 2,127,485 | 8/1938 | Owens et al. | 404/123 |
| 2,175,511 | 10/1939 | Wahlstrom et al. | 404/111 |
| 3,230,843 | 1/1966 | Santucci | 427/136 |
| 3,797,953 | 3/1974 | Lindskog | 404/103 |
| 4,192,626 | 3/1980 | Wyckoff et al. | 404/123 |
| 4,315,700 | 2/1982 | Heiligtag et al. | 404/111 |
| 4,575,279 | 3/1986 | Mateja | 404/111 |

FOREIGN PATENT DOCUMENTS

| | | | |
|---|---|---|---|
| 803212 | 1/1969 | Canada | 404/122 |

*Primary Examiner*—Stephen J. Novosad
*Assistant Examiner*—Matthew Smith
*Attorney, Agent, or Firm*—Charles R. Rhodes; Judith E. Garmon

[57] ABSTRACT

A coal-tar emulsion seal coat is applied atop, spread, and pressed into an asphalt pavement by a continuous rolling technique whereby liquid sealant is carried by and released from a delivery tank extending between the sides of a frame onto the asphalt surface. A first and second set of rollers extending between the frame sides spread and smooth an even pattern of sealant, then a third, smaller, lighter roller provides a finishing and touch-up operation.

9 Claims, 7 Drawing Figures

METHOD AND APPARATUS FOR APPLYING SEAL COATING TO ASPHALT PAVEMENT

BACKGROUND AND SUMMARY OF THE PRESENT INVENTION

This invention relates to paving techniques and more particularly to an improved technique for applying a coal-tar emulsion seal coat atop an asphalt pavement.

Asphalt pavement is continuously attacked by weather, chemicals, and vehicles. Over a period of time heat from the sun and moisture from rain and snow attack the binder in the asphalt pavement which eventually weakens it and destroys its flexibility. Gasoline and oil spillage also attack the binder resulting in a shorter life span. Naturally the wear from vehicles has its effect on asphalt surfaces.

As the asphalt binder becomes weaker and loses it flexibility, the aggregate stone in the asphalt becomes loose, permitting water to penetrate deeper which further accelerates the binder deterioration. Cracks and potholes soon form as vehicle traffic wear on the pavement weaknesses. Soon major repairs are required or an entirely new layer of asphalt is needed. It has been determined that if the asphalt binder can be protected and its integrity maintained the effective life of the asphalt pavement may be extended.

There has thus been developed a seal coat, generally formed of coal-tar emulsion, which is applied atop a newly paved asphalt surface. The seal coat beautifies, preserves, and protects the asphalt pavement from deterioration primarily because it protects the binder within the asphalt. The seal coat can be combined with sand to provide better traction, or can be applied with latex additives to toughen and increase resistance to wear, penetration, or chemical attack.

Previously the coal-tar emulsion has been applied by combinations of spraying, brushing, and/or smoothing with a squeegee. Examples of such approaches are illustrated in U.S. Pat. Nos. 3,807,634 to Vogt; 3,989,403 to Verive; 4,311,274 to Neal; and 4,315,700 to Heiligtag et al. While these techniques provide a somewhat improved life expectancy for the asphalt surfaces there remain unsolved problems as far as application techniques are concerned. For example the aforesaid techiques tend to require more sealant than would otherwise be required because where the surface is uneven, the sealant tends to accumulate to a deeper thickness in low spots, yet is often wiped clean on the high spots by the squeegee or brush. It is therefore difficult to apply an even pattern of seal coat with known techniques. Further, it is difficult to maintain the sealant and sand as a homogenous mixture where the mixture is sprayed then wiped with a squeegee or brush. Finally, neither the squeegee nor the brush apply sufficient pressure to press the sealant material into the asphalt and achieve sufficient penetration to make the sealant long lasting.

In accordance with the present invention, the aforesaid problems are confronted and solved by a rolling technique in which the sealant is first deposited as evenly as possible on the "raw" asphalt surface. The sealant is then soaked up into a mat carried on each of a plurality of rollers from which it is evenly spread across the asphalt surface under pressure. The sealant is thus pressed into the asphalt to achieve a greater penetration and extended life.

Toward this end there is provided a sealant reservoir and a rectangular roller frame which is either towed or pushed along the asphalt surface. A delivery tank extends between the sides of the frame adjacent the front edge thereof. A conduit connects the sealant reservoir with the delivery tank for maintaining the delivery tank full of sealant. The delivery tank includes a fluid outlet means in the bottom thereof for releasing fluid under a controlled flow pattern to the surface to be treated, which pattern extends substantially across the width of the frame. A first set of transversely extending, spaced rollers having a fibrous mat covering extends across the frame rearwardly of the delivery tank. The rollers in the first set are each pivotally mounted on a support rod which extends between the side walls of the frame. Immediately behind the first set of rollers is a second set of transversely extending, spaced rollers generally aligned with the spaces between the rollers in the first set. The rollers of the second set are also pivotally mounted on a support rod and provided with a fibrous mat to complete the spreading and application of an even coat of sealant over the asphalt surface.

A third smaller, lighter roller also pivotally mounted on a support rod extending transversely across the frame provides a finishing and touch-up function. The first two sets of rollers spread and press the seal coat evenly across and into the asphalt surface. Because of the fibrous mat covering the rollers, sand and sealant remain homogenously mixed therein and are applied evenly to both high and low places on the surface to be coated.

Other features included in the apparatus of the present invention include rubber guides extending rearwardly from the side edges of the delivery tank toward the side edges of the outermost rollers in the first set to ensure that the sealant that is initially deposited on the asphalt surface is directed to the rollers, as opposed to flowing outwardly out of control. Further, the frame includes a hydraulic cylinder for lifting the frame and the depending rollers from the surface of the asphalt for transportation and operation thereof. While the sets of rollers are pivotally suspended from support rods, stops associated with the frame limit the downward of the rollers.

It is therefore an object of the present invention to provide an improved technique for applying a seal coat to an asphalt surface.

It is another object of the present invention to provide a technique for applying a seal coat to an asphalt surface in which the seal coat is rolled onto and into the asphalt surface.

Other objects and a fuller understanding of the invention will become apparent from reading the following detailed description of a preferred embodiment along with the accompanying drawings in which.

DETAILED DESCRIPTION OF A PREFERRED EMBODIMENT

Figure 1:
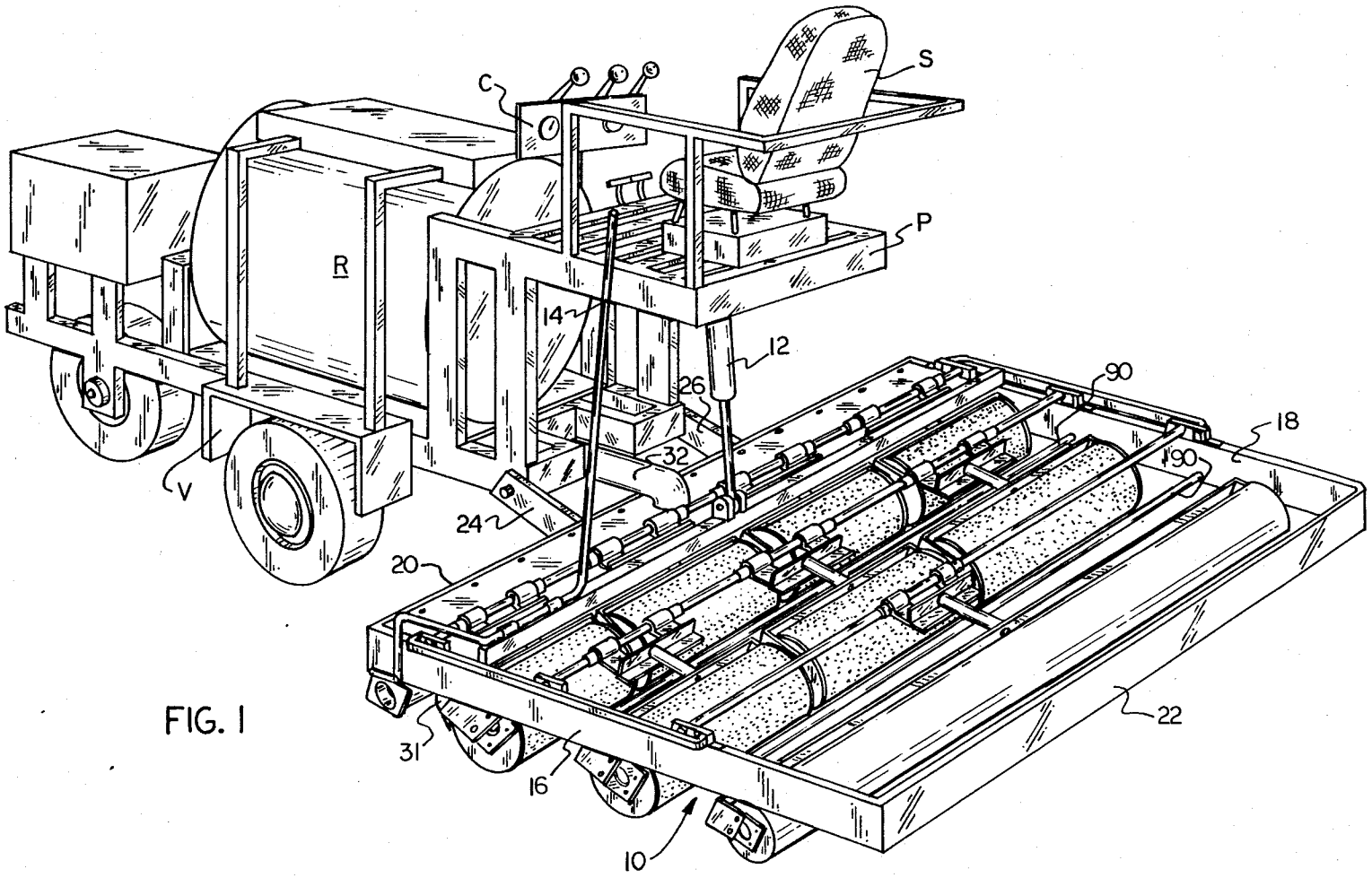
FIG. 1 is a perspective view illustrating the apparatus according to the present invention attached to an appropriate tow vehicle.

Turning now to the drawings, and particularly to FIG. 1, there is illustrated an apparatus according to the present invention which includes generally a motorized tow vehicle V having mounted thereon a relatively large sealant reservoir R and a roller frame 10 attached to the rear thereof. An operator seat S is mounted on a rear platform P in such a position as to enable the operator to view the surface ahead of vehicle V. A control panel C is mounted on platform P immediately in front of seat S. Hydraulic cylinder 12 connects platform P with frame 10 for lifting the frame when it is desired to transport the frame in non-engaging relationship to the asphalt surface as, for example, when loading or unloading the vehicle V onto some type of transportation trailer, when initially positioning the vehicle V to begin the sealant application operation, or when making turns or maneuvering the vehicle across the asphalt pavement at such times when application or treatment of the pavement is not desired. A control handle 14 also enables the operator in seat S to control the times at which sealant is applied to the asphalt pavement and when the flow of sealant is to be interrupted.

Figure 2:
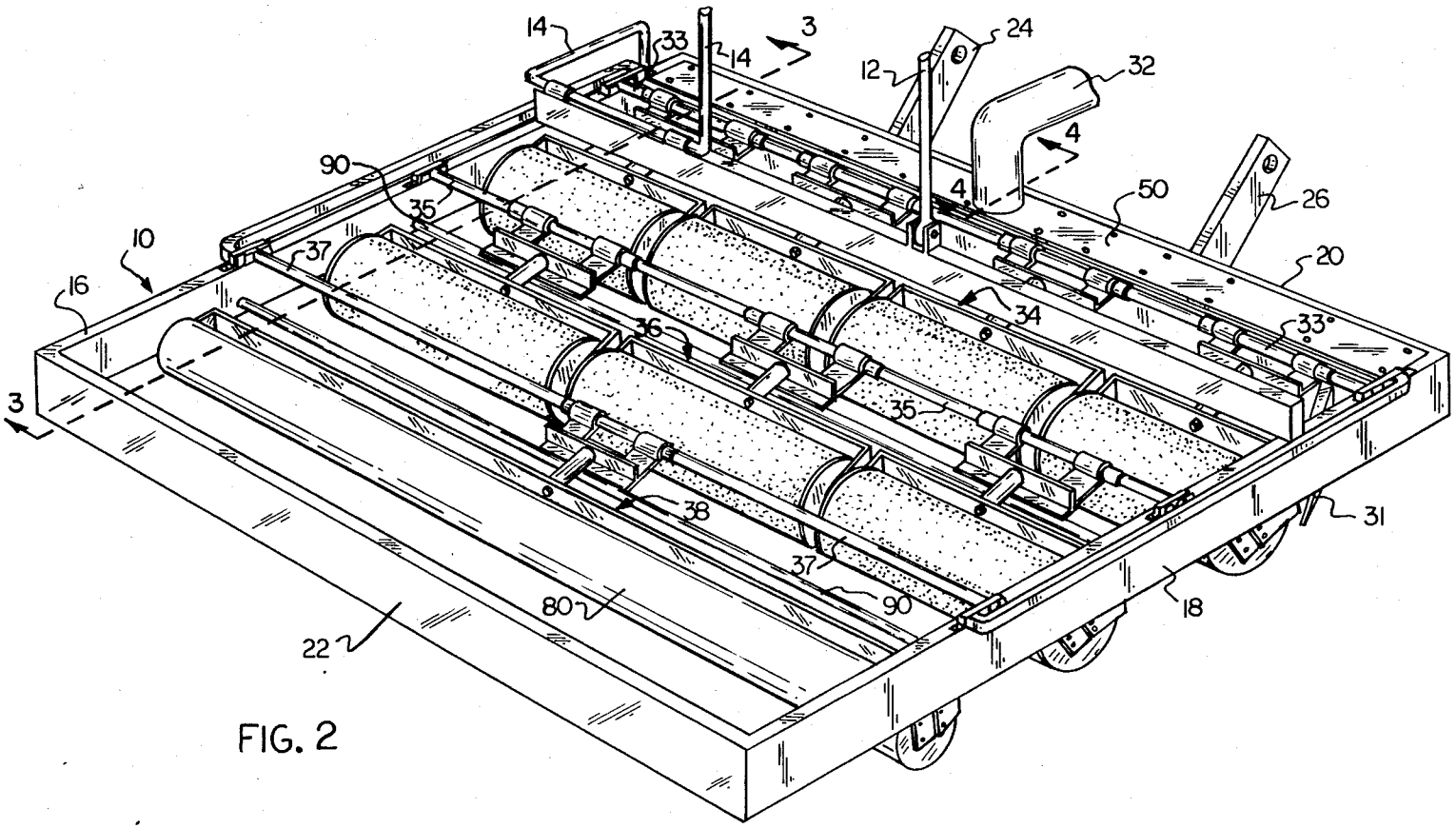
FIG. 2 is an enlarged perspective of the roller frame alone.

Turning now to FIG. 2 there appears an enlarged illustration of the frame 10 which includes a pair of side members 16,18, a front member 20, and a rear member 22 welded together in a rectangular shape. A pair of mating, forwardly extending tongues 24,26 provide means for attaching frame 10 to the rear frame of vehicle V. A delivery tank or tube 30 extends across the width of roller frame 10 from side member 16 to side member 18 adjacent the front member 20 thereof and is connected to the large reservoir R by means of a conduit 32. Delivery tube 30 includes a fluid outlet means therein for releasing fluid under controlled flow to the asphalt surface to be treated. The fluid outlet means will be described more in detail hereinafter in connection with the description of FIG. 4 and is controlled by handle 14 which controls the opening and closing of the fluid outlet means in delivery tube 30.

Figure 3:
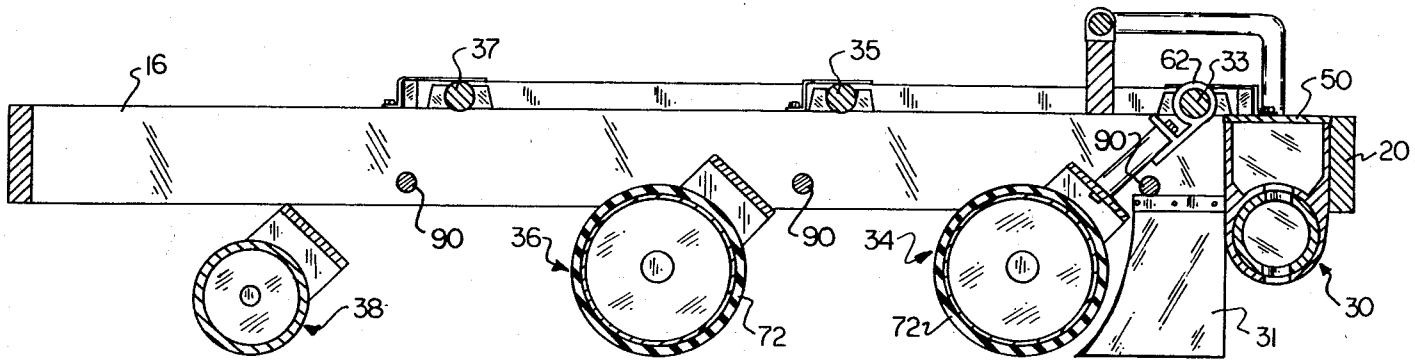
FIG. 3 is a cross-sectional view of the roller frame taken substantially along lines 3—3 in FIG. 2.

Further, the roller frame 10 includes three sets of transversely extending rollers 34,36, and 38. Each set of rollers is pivotally suspended from a support rod 33,35, and 37 which extends across the width of frame 10 between side members 16 and 18 at points successively spaced rearwardly from the delivery tank 30. The details of each roller set 34,36 and 38 will be described hereinafter with reference to FIGS. 3, 5, and 6; however, it should here be pointed out that the first roller set 34 includes a plurality of transversely extending, spaced rollers across the frame immediately rearwardly of the delivery tank 30. The second roller set 36 is pivotally suspended from support rod 35 at a point spaced approximately twenty inches rearwardly from rod 33. The spaced rollers in the second roller set 36 are so positioned as to align with the spaces between the rollers of the first roller set 34. So arranged sealant which passes between the rollers of the first set is caught, spread evenly, and merged with the previously spread sealant by the rollers of the second roller set 36. In the preferred embodiment there are four rollers in first roller set 34 and three rollers in second roller set 36. The rollers in sets 34 and 36 are all approximately seven inches in diameter, formed of steel and relatively heavy. The third roller set 38 is suspended from support rod 37, again spaced approximately twenty inches rearwardly of the support rod 35. The third roller is slightly smaller in diameter and lighter than the first and second roller sets because is serves as a touch-up and finishing roller. In the preferred embodiment this roller is approximately six and one-half inches in diameter.

Once the sealant is distributed or initially applied to the pavement from delivery tank 30, the first set of rollers 34 serves to spread the sealant as they pass thereover and allow some sealant to pass between adjacent rollers. The sealant that passes between adjacent rollers of the first roller set 34 is spread and distributed by the rollers of the second roller set 36. Since the rollers of roller sets 34 and 36 are pivotally suspended from support rods 33 and 35 respectively, they serve the spread an even coat of sealant on the asphalt surface regardless of the smoothness or levelness thereof. Further, the weight of the rollers in roller sets 34,36 tend to press the sealant into the asphalt so that it penetrates to a greater extent than applications in which the sealant is merely sprayed, brushed, or applied with a squeegee.

Figure 7:
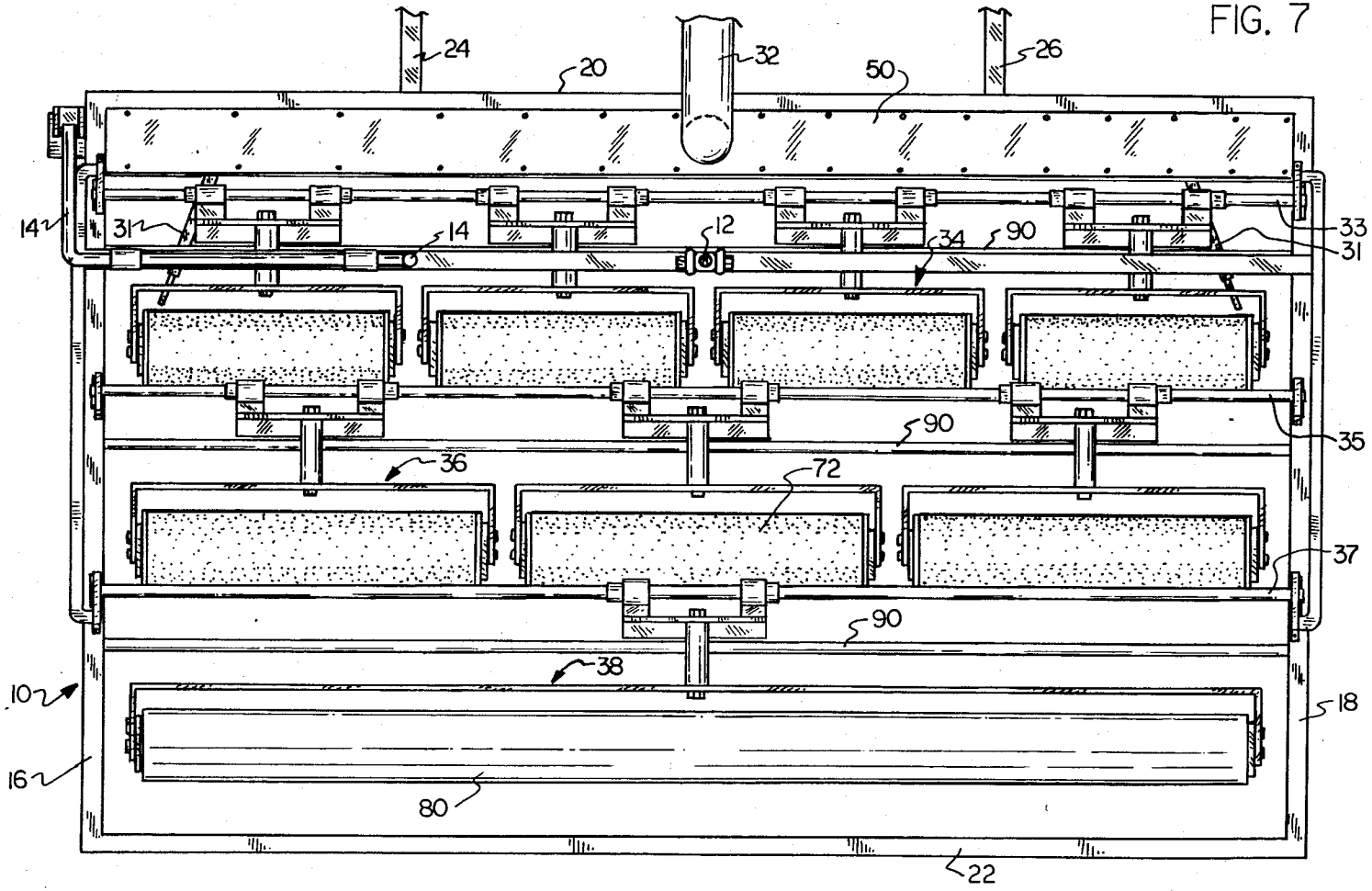
FIG. 7 is a plan view of the roller assembly removed from the tow vehicle.

Turning now to FIG. 7, there is illustrated a plan view of the roller frame which shows the relative location of the delivery tank 30 and roller sets 34,36, and 38. It should be noted that the length of delivery tank 30 is slightly less than the width of the roller sets. Thus, all sealant deposited by the delivery tank 30 onto the asphalt surface come under the influence of the roller sets 34,36 as the roller frame 10 proceeds. Further, a pair of rearwardly and outwardly directed rubber end walls 31 ensure that the sealant does not escape beyond the extremity of the outer rollers of roller set 34.

Figure 4:
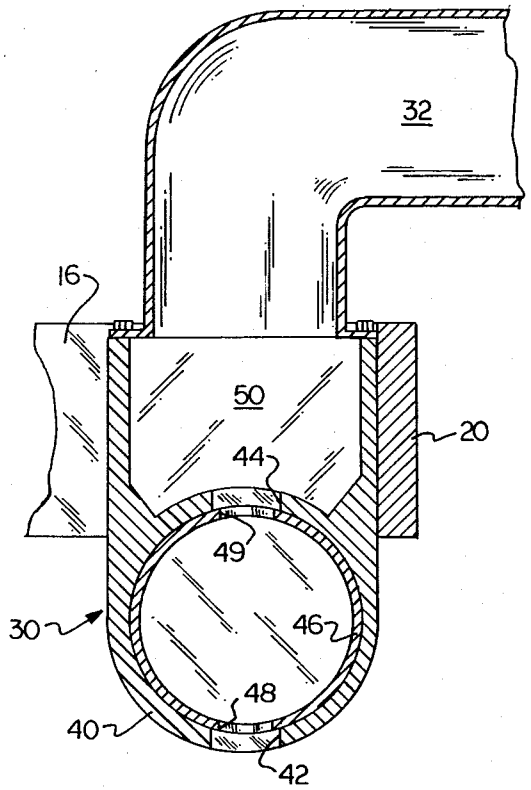
FIG. 4 is a cross-sectional view of the delivery tank taken substantially along lines 4—4 in FIG. 2.

Turning now to FIG. 4 there is illustrated in cross-section a preferred embodiment of the delivery tank or tube 30 which receives sealant from conduit 32 and initially distributes it onto the asphalt surface. While the delivery tank 30 could take a variety of forms one satisfactory approach is illustrated in FIG. 4. Toward this end the conduit 32 leading from reservoir R enters into a covered holding tank 50. At the bottom of the holding tank is mounted the aforementioned fluid outlet means which includes an outer tube 40 welded or otherwise secured to the lower edges of the side walls of tank 50. Tube 40 includes a first plurality of spaced, elongated slots 42 along the length of the lower edge thereof and a second plurality of spaced, longitudinally extending slots 44 along the upper edge thereof. An inner tube 46 also includes a plurality of lower slots 48 and upper slots 49 which register or align with slots 42,44 respectively. The inner tube 46 is rotatable with respect to outer tube 40 and the rotation thereof is controlled by control handle 14. When the inner tube 46 is rotated by handle 14 so that slots 48,49 register with slots 42,44 respectively, sealant is permitted to flow through the delivery tank and onto the asphalt surface. When the inner tube 46 is rotated to a second position in which the slots 48,49 are rotated at least 30° and out of registration with slots 42,44, application of the sealant is interrupted. Thus, a very simple fluid outlet control is provided. It should be recognized that this fluid flow control means is exemplary only and there could be various types of control valves and applicators which could provide a controlled application of sealant in front of roller sets 34,36. For example a plurality of nozzles could be used in place of the slotted pipe 40.

Figure 5:
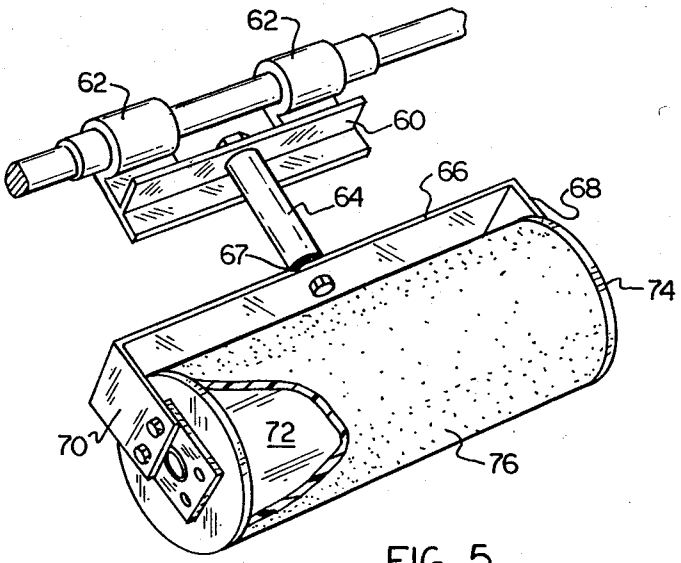
FIG. 5 is a perspective view of a roller assembly of the type used in the first and second sets of transverse rollers.

FIG. 5 is exemplary of the rollers in the first and second roller sets 34,36. Toward this end a mounting bracket 60 includes a spaced pair of bushings or bearings 62 which slide onto or over one of rods 33 or 35. A stud receiving, internally threaded sleeve 64 is welded or otherwise secured to the opposite side of bracket 60 from bearings 62. A roller support bracket 66 having a pair of arms 68,70 is rotatably attached to sleeve 64 by means of a threaded stud 67, the bracket plate 66 being so attached to stud 67 as to be free to rotate thereabout. A roller 72 is then rotatably mounted between the free ends of arms 68,70 in any conventional manner. Roller 72 includes end walls or rings 74 extending radially outwardly about one-half inch beyond roller surface 72. The roller support bracket 66 and arms 68,70 are of such size and length with respect to the elevation of frame 10 in the first operative position that the angle between the support rods 33,35 and the axis of rollers 74 is approximately 45°.

A mat 76 formed of absorptive fibrous, foam, or sponge material is secured to the surface of roller 72. The mat 76 is approximately three-quarters inch thick so as to extend approximately one-quarter inch beyond the rims of rings 74. So arranged, the absorptive mat 76 will absorb and maintain a reservoir of seal coat therein. Alternatively when sand is mixed with the seal coat, the seal coat and sand will be retained in a homogenous mixture. As the rollers 72 proceed across the asphalt surface the top of the surface is coated with a prescribed thickness. The weight of the rollers tend to press the seal coat into the asphalt so that it penetrates to a greater extent, thus extending the life thereof. The resiliency of the mat permits rough spots in the asphalt to be coated with an even coat of the sealant and will also effect an even application of sealant to high and low places. Since the rollers 72 are pivotal up and down about the rods 33,35 and also pivotal about the longtudinal axis of stud 67, a more even application of sealant is achieved.

Figure 6:
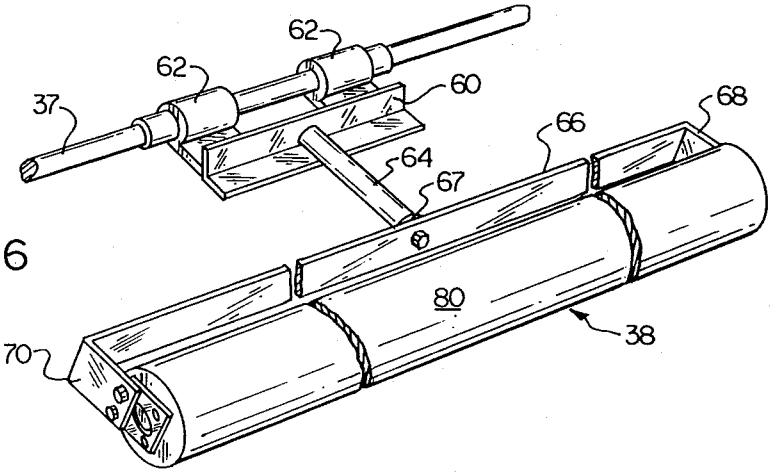
FIG. 6 is a perspective view of a roller assembly of the type used in the third roller.

Turning to FIG. 6, there is illustrated a typical type of roller 80 forming the third roller assembly 38. Roller 80 is substantially identical to rollers 72 with the exception of the elimination of rims 74 and the fact that the roller is smaller (six and one-half inches in diameter rather than seven inches in diameter) and thus lighter. While the mat material is preferably applied to roller 80, it is not as necessary as in the case of rollers 72.

While the hydraulic cylinder 12 may be operated to lower frame 10 to a desired horizontal level above the asphalt surface (first operative position) which tends to limit the upward pivotal movement of all rollers, some type of stop device is necessary to prevent excessive downward rotation of the roller brackets 66 when the frame 10 is lifted to the second inoperative position. Toward this end a stop bar or lug 90 is provided on frame 10 in association with each roller set 34,36,38 to limit the extent of downward rotation of the roller brackets when the frame 10 is lifted.

While a preferred embodiment of the invention has been described in detail hereinabove, it is obvious that various changes and modifications might be made without departing from the scope of the invention which is set forth in the following claims.

What is claimed is:

1. An improved method for applying a sealant material to asphalt pavement comprising the steps of:

(a) depositing a controlled flow of sealant material from a delivery tank operation in an elongated pattern substantially across the entire width of a prescribed strip of said asphalt pavement at a prescribed rate;

(b) simultaneously spreading said sealant coat onto and pressing said sealant coat into the surface of said asphalt pavement solely by a first rolling operation utilizing a plurality of spaced spreading rollers without any intermediate squeegee operation which combines the characteristics of rolling and applying sufficient downward pressure to press a portion of said sealant coat into the asphalt; and (c) touching up said strip of sealant by a second rolling operation utilizing a rolling apparatus adjacent and smaller and lighter than said spreading rollers which combines further rolling while applying a relatively lighter downward pressure than is applied in said spreading step.

2. The method according to claim 1 wherein said spreading step includes the absorption of said sealant into a mat of absorbent material wrapped around said spreading rollers which maintains a reservoir of said sealant which is applied slowly and evenly during said rolling operation.

3. Apparatus for applying a seal coat to asphalt surface comprising:

(a) a tow vehicle having a sealant reservoir mounted thereon;

(b) a roller support frame including a front frame member, a rear frame member, and two side frame members joined together to form said support frame;

(c) a delivery tank extending transversely across said roller support frame between said side members adjacent the front member thereof, a conduit means connecting the sealant reservoir with said delivery tank, and a fluid outlet means for providing a controlled release of said sealant to said asphalt surface to be treated substantially across the width of said frame;

(d) a plurality of spaced spreading rollers extending transversely across said frame rearwardly of said fluid outlet means of said delivery tank, and a support rod means extending across said frame between said side members on which said plurality of spaced rollers are pivotally mounted; and (e) a finishing roller extending across said roller frame rearwardly of said spreading rollers, a support rod means extending across said frame between said side members on which said finishing roller is pivotally mounted, said finishing roller being smaller and lighter than said spreading rollers for touching up the seal coat application.

4. The apparatus according to claim 3 wherein said spreading rollers include a first and second set, said second set being positioned rearwardly of said first set and so arranged that the rollers thereof are aligned with the spaces between the rollers of said first set.

5. The apparatus according to claim 3 and further including a lift means connecting said tow vehicle and said support frame for selectively moving said frame between a first operative position where said spreading and lifting rollers are in contact with said asphalt surface and a second inoperative position where said rollers are elevated above said asphalt surface.

6. The apparatus according to claim 5 and further including stop means associated with said frame for limiting the downward rotational movement of said spreading and lifting rollers when said frame is moved from the first to the second position.

7. The apparatus according to claim 3 wherein said fluid outlet means comprises a plurality of spaced longitudinal slots in the bottom of said delivery tank extending substantially the length thereof and a control means for selectively opening and closing said slots.

8. The apparatus according to claim 6 and further including a pair of spaced end walls secured to each end of said delivery tank and extending rearwardly therefrom, said end walls lying closely adjacent said asphalt surface when said frame is lowered to the first operative position, said end walls preventing escape of sealant thereunder prior to the time said sealant is engaged by said spreading rolls.

9. The apparatus according to claim 3 wherein at least said spreading rollers further include an absorbant mat means secured to the surface thereof for absorbing said sealant therein and aiding in the even distribution thereof.

* * * * *